US011774220B2

(12) United States Patent
Chu et al.

(10) Patent No.: US 11,774,220 B2
(45) Date of Patent: Oct. 3, 2023

(54) ANNULAR SHAPED-CHARGE HOUSING FOR BLASTING AND METHOD OF USING THE SAME

(71) Applicant: Shandong University of Technology, Zibo (CN)

(72) Inventors: Fujiao Chu, Zibo (CN); Wentao Lan, Zibo (CN); Gongcheng Li, Zibo (CN); Zimin Ma, Zibo (CN); Zhihe Liu, Zibo (CN)

(73) Assignee: SHANDONG UNIVERSITY OF TECHNOLOGY, Shandong (CN)

( * ) Notice: Subject to any disclaimer, the term of this patent is extended or adjusted under 35 U.S.C. 154(b) by 0 days.

(21) Appl. No.: 17/890,490

(22) Filed: Aug. 18, 2022

(65) Prior Publication Data

US 2023/0168069 A1 Jun. 1, 2023

(30) Foreign Application Priority Data

Nov. 30, 2021 (CN) ..... 202111439273.2

(51) Int. Cl.
*F42B 1/02* (2006.01)
*F42B 1/028* (2006.01)
(Continued)

(52) U.S. Cl.
CPC ..... *F42B 1/02* (2013.01); *F42B 1/028* (2013.01); *F42B 1/036* (2013.01); *F42B 3/00* (2013.01); *F42B 3/08* (2013.01); *F42D 1/00* (2013.01)

(58) Field of Classification Search
CPC .... F42B 1/02; F42B 1/036; F42B 3/00; F42B 3/08; F42B 12/10; F42B 1/028;
(Continued)

(56) References Cited

U.S. PATENT DOCUMENTS 4,543,703 A * 10/1985 Wetzel ..... E21B 43/045 29/455.1
9,074,855 B1 * 7/2015 Frericks ..... F42B 1/02
9,303,961 B1 * 4/2016 Frericks ..... F42B 1/032
(Continued)

FOREIGN PATENT DOCUMENTS

CN 103983153 A * 8/2014 ..... F42D 3/04
CN 114111459 A * 3/2022 ..... F42B 3/04
(Continued)

OTHER PUBLICATIONS

Machine translation of CN-114111459-A (Year: 2022).*
Machine translation of CN-103983153-A (Year: 2014).*
Machine translation of WO 2016/034595 A1 (Year: 2016).*

*Primary Examiner* — James S Bergin
(74) *Attorney, Agent, or Firm* — Terry M. Sanks, Esq.; Beusse Sanks, PLLC

(57) ABSTRACT

An annular shaped-charge and blasting housing and a use method thereof are provided. The annular shaped-charge and blasting housing includes a PVC segment and multiple notch grooves. Grooves are notched on a W-shaped PVC segment formed by machining. The notching angle of the groove and the spacing distance between the grooves can be adjusted according to use requirements. And, the W-shaped PVC segment after being cut may not be limited to have eight notch grooves, and the number of the notch grooves of a single one PVC segment can be adjusted according to actual working conditions. The PVC segment can be folded and closed to form the annular shaped-charge and blasting housing. Therefore, the housing of the embodiments is simple in production, the linear segment can be bended and folded by utilizing the plasticity of the PVC material. The manufacturing process of the housing is simple and feasible. The housing of the embodiments is convenient to use and can meet the requirements of the annular shaped-charge
(Continued)

cutting in blasting engineering. Meanwhile, the housing of the embodiments are widely applied. Further, the housing is not only applicable to annular shaped-charge cutting for the bottoms of holes to improve the planeness of the tunnel faces or the berm for the bench blasting, but also applicable to the cut blasting to improve the cut effect.

5 Claims, 3 Drawing Sheets

(51) Int. Cl.

| | |
|---|---|
| ***F42B 1/00*** | (2006.01) |
| ***F42D 1/00*** | (2006.01) |
| ***F42B 3/00*** | (2006.01) |
| ***F42B 3/08*** | (2006.01) |
| ***F42B 1/036*** | (2006.01) |

(58) Field of Classification Search
CPC ..... E21B 43/116; E21B 43/117; F42D 1/00; F42D 1/22; F42D 3/00; F42D 3/04; B26F 3/04
USPC ..... 102/306, 307, 308, 309, 310, 331, 332, 102/476
See application file for complete search history.

(56) References Cited

U.S. PATENT DOCUMENTS

| | | | | |
|---|---|---|---|---|
| 9,441,924 | B1 * | 9/2016 | Frericks | F42B 1/028 |
| 2021/0302134 | A1 * | 9/2021 | Galloway | F42B 1/036 |

FOREIGN PATENT DOCUMENTS

| | | | | |
|---|---|---|---|---|
| GB | 2214618 | A * | 9/1989 | F42B 1/02 |
| WO | WO-2016034595 | A1 * | 3/2016 | F42D 3/00 |

* cited by examiner

ANNULAR SHAPED-CHARGE HOUSING FOR BLASTING AND METHOD OF USING THE SAME

TECHNICAL FIELD

The present disclosure relates to a housing for blasting, and in particular relates to an annular shaped-charge housing for blasting and a method of using the same, which belongs to the technical field of energy gathering effect.

BACKGROUND ART

The energy gathering effect is a phenomenon in which the energy flow density is increased and the blasting effect is enhanced by gathering explosive products via the application of explosive loading in a special shaped manner. At present, the shaped-charge explosive loading has been widely used in residential explosion equipment and blasting engineering, such as cutting stones and steel plates, cutting shipwrecks and pile foundations. In geotechnical engineering, when people conduct the profile-controlling blasting, an energy gathering technique is used to control a cracking direction of rocks, so as to form flat profile planes. Currently, the most widely used shaped-charge device for blasting is the longitudinal and linear shaped-charge pipe, and the housing of the shaped-charge pipe can facilitate to improve the accuracy of profile controlling.

In blasting engineering, particularly in the excavation blasting for tunnels, roadway, underground chamber, and the like, the drill-holes are used for cut holes and breaking holes in addition to the perimeter holes for profile controlling. The cut holes are mainly used for blasting a new free face under the action of a relatively large rock clamping. And, the breaking holes are mainly blast holes for performing the tunnelling blasting. In the blasting process, a cut effect needs to be improved, and there is also a certain requirement on the planeness of a new tunnel face being formed after the breaking holes blasted, With regard to improving the cut effect, it is mainly considered that how to improve the energy utilization rate of explosives, so as to enable the explosion to create more cracks and thus break more rocks. In order to improve the planeness of the tunnel face, there is a certain requirement on the accuracy of the depth of the blast holes, and further the control of the energy distribution of the explosives in the blast holes. In addition, the open-pit bench blasting also needs a flat platform for the bench blasting. Thus, how to improve the planeness of the platform is also worthy of studying.

At present, numerous researchers use the energy gathering theory for the cut and the profile controlling. The energy gathering of the perimeter holes for blasting is the most widely applied, so as to control the profile. There are few researchers study on circumferential energy gathering at the bottoms of holes for blasting, and related invention patents are even fewer. The study of increasing the cut effect via the shaped-charge explosive loading is also very rare, so people mainly focus on multi-directional shaped-charge cut.

SUMMARY

In order to solve the problems in the background art, the present disclosure provides an annular shaped-charge housing for blasting and a method of using the same.

In order to achieve the above purpose, the present disclosure provides the following technical scheme: an annular shaped-charge housing for blasting, including a PVC segment which is strip-shaped to form a main body structure of the blasting housing, a annular polygonal shaped-charge housing is formed by folding the PVC segment; inner grooves which are arranged on an inner side of the PVC segment in a thickness direction of the PVC segment, the inner side forms an inner side of the annular polygonal shaped-charge housing which faces a center of the annular polygonal shaped-charge housing; an outer groove which is located on a middle portion of an outer side of the PVC segment, the outer side forms an outer side of the annular polygonal shaped-charge housing which faces away from the center of the annular polygonal shaped-charge housing, and the inner grooves are symmetrically formed with respect to the outer groove; and multiple notch grooves which are notched on the inner side of the PVC segment, the multiple notch grooves run through a first end and a second end of the PVC segment and extend in a length direction of the PVC segment.

In some embodiments, a cross section of the PVC segment may be W-shaped by stamping process, the inner side of the PVC segment that is W-shaped may be formed with the inner grooves, and the outer groove may be formed on the outer side of the PVC segment that is W-shaped.

In some embodiments, an opening of the outer groove of the PVC segment that is W-shaped may have an angle of 60 degree.

In some embodiments, the multiple notch grooves notched on the PVC segment may be spaced apart a predetermined distance from each other along the length direction of the PVC segment, a cross section of each of the multiple notch grooves which is perpendicular to the length direction of the PVC segment may be V-shaped, and an opening of each of the multiple notch grooves may have an angle that ranges from 40 degree to 60 degree.

In some embodiments, a wall of the PVC segment may have a thickness that ranges 1 mm to 2 mm.

The present disclosure further discloses a method of using the annular shaped-charge housing for blasting, the method includes the following steps. Enabling a cross section of the PVC segment to be W-shaped by stamping process; notching the multiple notch grooves that are V-shaped on the inner side of the PVC segment, and spacing apart the multiple notch grooves a determined distance from each other; cutting the PVC segment that is W-shaped, on which eight of the multiple notch grooves are notched, from an integral PVC segment; folding the PVC segment after being cut, so as to form an octagonal annular housing by closing an opening of each of the notch grooves; placing the octagonal annular housing to a bottom of a hole to be exploded after filling explosive into the octagonal annular housing, and enabling the outer groove of the octagonal annular housing to face towards and be perpendicular to a wall of the hole.

The embodiments have achieved the following technical effects. Grooves are notched on a W-shaped PVC segment formed by machining. The notching angle of the groove and the spacing distance between the grooves can be adjusted according to use requirements. And, the W-shaped PVC segment after being cut may not be limited to have eight notch grooves, and the number of the notch grooves of a single one PVC segment can be adjusted according to actual working conditions. The PVC segment can be folded and closed to form the annular shaped-charge housing. Therefore, the housing of the embodiments is simple in production, the linear segment can be bended and folded by utilizing the plasticity of the PVC material. The manufacturing process of the housing is simple and feasible. The housing of the embodiments is convenient to use and can meet the requirements of the annular shaped-charge cutting in blasting engineering. Meanwhile, the housing of the embodiments are widely applied. Further, the housing is not only applicable to annular shaped-charge cutting for the bottoms of holes to improve the planeness of the tunnel faces or the berm for the bench blasting, but also applicable to the cut blasting to improve the cut effect.

List of reference signs: 1 PVC segment; 2 inner groove; 3 outer groove; 4 notch groove 5 inner side of PVC segment; 6 outer side of PVC segment; 7 first end; 8 second end.

DETAILED DESCRIPTION OF THE EMBODIMENTS

The following clearly and completely describes the technical solutions in the embodiments of the present disclosure in combination with the accompanying drawings in the embodiments of the present disclosure. Apparently, the described embodiments are merely a part rather than all of the embodiments of the present disclosure. All other embodiments obtained by persons of ordinary skill in the art based on the embodiments of the present disclosure without creative efforts shall belong to the scope of protection of the present disclosure.

Embodiment 1

Figure 1:
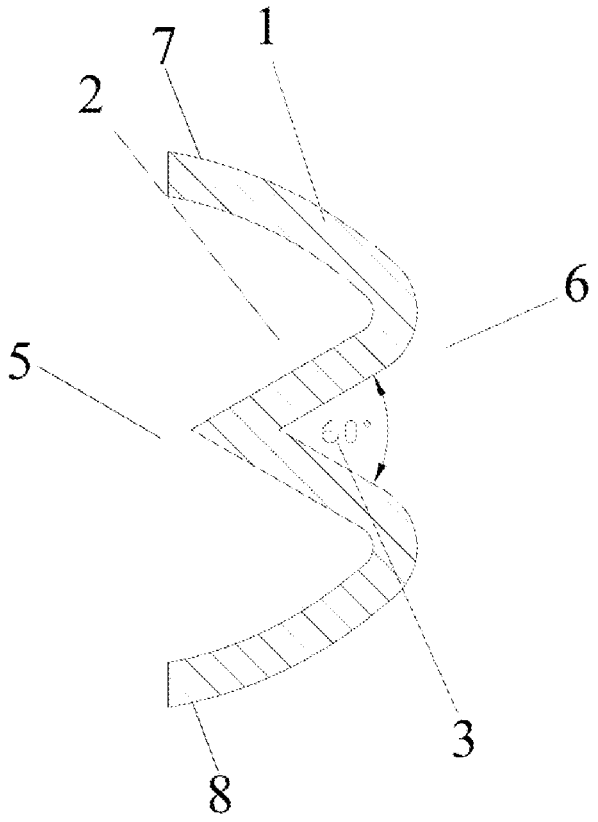
FIG. 1 is a schematic cross-sectional view of a PVC segment according to embodiment of the present disclosure.
Figure 2:
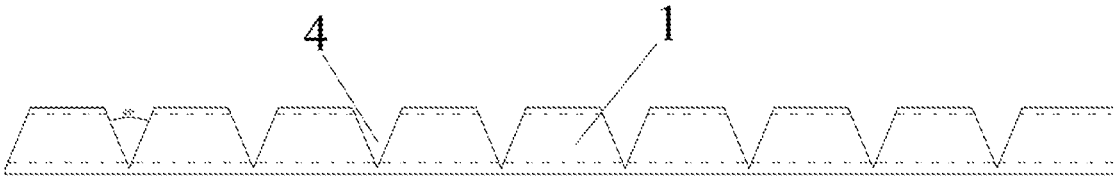
FIG. 2 is a schematic diagram of the PVC segment on which grooves are notched according to an embodiment of the present disclosure.
Figure 3:
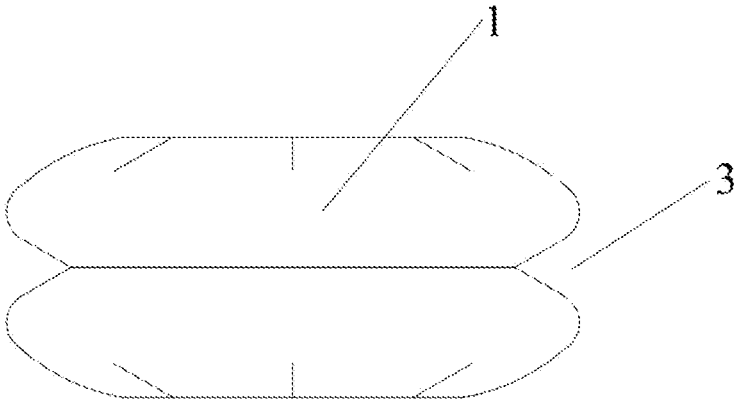
FIG. 3 is a front view of a shaped-charge housing for blasting after being folded and closed according to an embodiment of the present disclosure.
Figure 4:
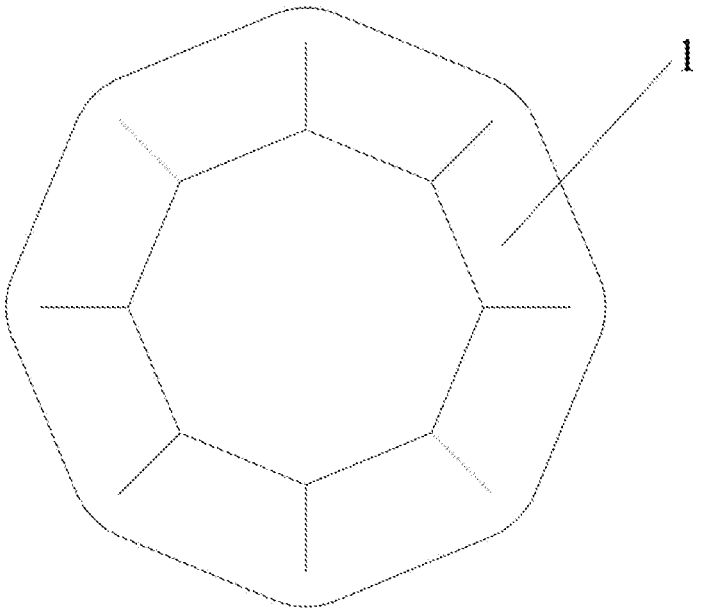
FIG. 4 is a top view of the shaped-charge housing for blasting after being folded and closed according to an embodiment of the present disclosure.
Figure 5:
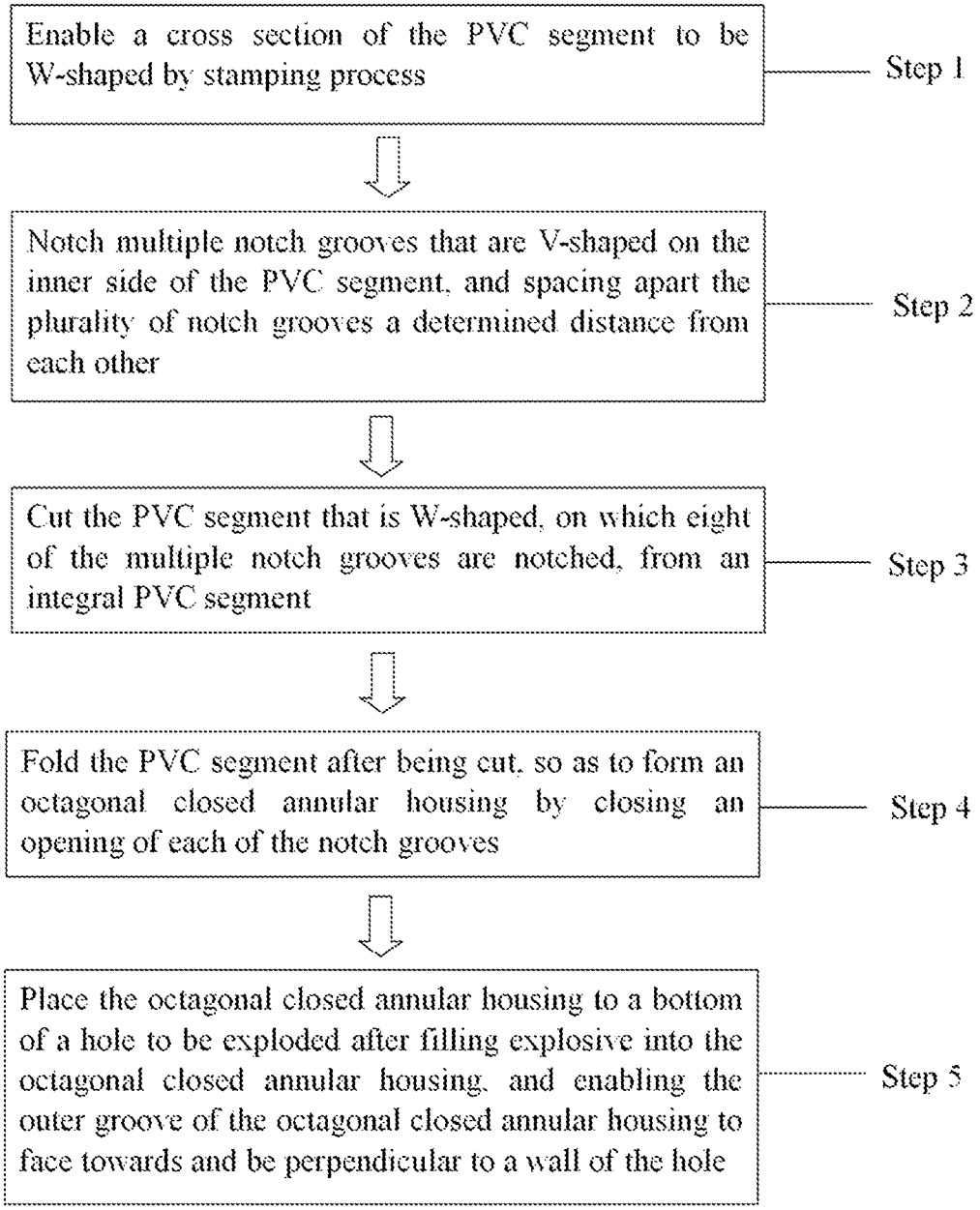
FIG. 5 is a schematic flow diagram of a method of using an annular shaped-charge housing for blasting according to an embodiment of the present disclosure.

With reference to FIGS. 1-4, an annular shaped-charge housing for blasting is provided. The annular shaped-charge housing for blasting includes a PVC segment 1 which is strip-shaped to form a main body structure of the blasting housing, a annular polygonal shaped-charge housing is formed by folding the PVC segment; inner grooves 2 which are arranged on an inner side 5 of the PVC segment 1 in a thickness direction of the PVC segment, the inner side 5 forms an inner side of the annular polygonal shaped-charge housing which faces a center of the annular polygonal shaped-charge housing; an outer groove 3 which is located on a middle portion of an outer side 6 of the PVC segment, the outer side 6 forms an outer side of the annular polygonal shaped-charge housing which faces away from the center of the annular polygonal shaped-charge housing, and the inner grooves are symmetrically formed with respect to the outer groove; and multiple notch grooves 4 which are notched on the inner side 5 of the PVC segment, the multiple notch grooves 4 run through the first end 7 and the second end 8 of the PVC segment and extend in a length direction of the PVC segment.

In the embodiment of the present disclosure, a cross section of the PVC segment 1 is W-shaped by stamping process, the inner side 5 of the PVC segment 1 that is W-shaped is formed with the inner grooves 2, and the outer groove 3 is formed on the outer side 6 of the PVC segment 1 that is W-shaped.

In the embodiment of the present disclosure, an opening of the outer groove 3 of the PVC segment 1 that is W-shaped has an angle of 60 degree.

In the embodiment of the present disclosure, the multiple notch grooves 4 notched on the PVC segment 1 are spaced apart a predetermined distance from each other along the length direction of the PVC segment, a cross section of each of the multiple notch grooves 4 which is perpendicular to the length direction of the PVC segment is V-shaped, and an opening of each of the multiple notch grooves 4 has an angle that ranges from 40 degree to 60 degree.

In the embodiment of the present disclosure, a wall of the PVC segment 1 has a thickness that ranges 1 mm to 2 mm.

Embodiment 2

In step 1, an annular shaped-charge housing for blasting is provided, and a special shaped PVC segment 1 has a W-shaped cross section. An opening of a bottom portion of the W-shaped PVC segment 1 is a shaped-charge hole, which has an angle of 60 degree. And, the thickness of the wall of the PVC segment 1 is 2 mm. In step 2, grooves are notched on the PVC segment and a distance between every two notch grooves is 18 mm. The opening of each of the notch grooves has an angle of 45 degree. In step 3, the W-shaped PVC segment 1 is cut from the integral segment, and includes eight notch grooves. In step 4, the PVC segment after being cut is folded so as to form the annular shaped-charge housing by closing and adhering the opening of each of the notch grooves. The maximum radial size of the annular shaped-charge housing is about 45 mm. In step 5, the housing is placed to bottom faces of the profile of the blast hole together with the explosive, after the explosive is filled into the housing. Further, the outer shaped-charge hole of the housing faces towards and is perpendicular to a corresponding wall of the blast hole. After the explosion, the shaped-charge jets are produced by the shaped-charge holes, which can cut the surrounding rock of walls of the blast holes, thereby forming a relatively flat and new tunnel face.

Embodiment 3

In step 1, an annular shaped-charge housing for blasting is provided, and a special shaped PVC segment 1 has a W-shaped cross section. An opening of a bottom portion of the W-shaped PVC segment 1 is a shaped-charge hole, which has an angle of 60 degree. And, the thickness of the wall of the PVC segment 1 is 2 mm. In step 2, grooves are notched on the PVC segment and a distance between every two notch grooves is 18 mm. The opening of each of the notch grooves has an angle of 45 degree. In step 3, the W-shaped PVC segment 1 is cut from the integral segment, and includes eight notch grooves. In step 4, the PVC segment after being cut is folded so as to form the annular shaped-charge housings by closing and adhering the opening of each of the notch grooves. The maximum radial size of the each of the annular shaped-charge housings is about 45 mm. In step 5, the housing is placed to the cut holes together with the explosive, after the explosive is filled into the housing. One annular shaped-charge housing that is filled with the explosive is provided between every adjacent two packs of explosives, and the outer shaped-charge hole of the housing faces towards and is perpendicular to a wall of the hole. After the explosion, the shaped-charge jets are produced by the shaped-charge holes, which can increase the production of cracks of hole walls, thereby improving the cut effect.

The working principle is as follows. The cross section of the PVC segment 1 is W-shaped by stamping process. The multiple V-shaped notch grooves 4 are notched on the W-shaped PVC segment 1, and are spaced apart a predetermined distance from each other. The W-shaped PVC segment 1 on which the multiple notch grooves 4 are notched is cut from the integral segment, and includes eight notch grooves 4. The PVC segment after being cut is folded so as to form the octagonal annular housing by closing the opening of each of the notch grooves 4. The housings after being filled with explosive are placed to bottoms of holes or other desired positions, and the outer groove 3 of each of the housings faces towards and is perpendicular to a corresponding wall of each of the holes.

It will be apparent to those skilled in the art that the present disclosure is not limited to the details of the foregoing exemplary embodiments. And the present disclosure may be realized in other specific forms without departing from the spirit or essential characteristics of the present disclosure. Therefore, the embodiments is considered as exemplary and not restrictive in all respects. The scope of the present disclosure is defined by the appended claims rather than the foregoing description. Accordingly, all changes that come within the meaning and scope of equivalency of the claims are intended to be embraced in the present disclosure. Any reference signs in the claims shall not be construed as limiting the claims referred to.

In addition, it should be understood that although the description is given according to the embodiments, each embodiment does not only include an independent technical solution. This narrative manner of the description is only for clarity. Those skilled in the art should make the description as a whole, and the technical solutions in each embodiment may also be appropriately combined to form other embodiments that can be understood by those skilled in the art.

Amendments to the Specification:

The Examiner is requested to replace the specification (excluding the claims and Abstract) with the concurrently filed Substitute Specification in compliance with 37 C.F.R. § 1.121 and 37 C.F.R. §§ 1.125(a) and (c). The amendments to the specification are submitted in a marked-up version of the specification, as required by §§ 1.125(c). No new matter has been added.

What is claimed is:

1. A PVC segment for forming an annular shaped-charge and blasting housing, comprising:

inner grooves (2) which are arranged on an inner side (5) of the PVC segment (1) in a thickness direction of the PVC segment, wherein the inner side (5) forms an inner side of the annular shaped-charge housing which faces a center of the annular shaped-charge housing;

an outer groove (3) which is located on a middle portion of an outer side (6) of the PVC segment (1), wherein the outer side (6) forms an outer side of the annular shaped-charge housing which faces away from the center of the annular shaped-charge housing, and the inner grooves are symmetrically formed with respect to the outer groove, wherein a cross section of the PVC segment (1) is W-shaped by stamping process, the inner side (5) of the PVC segment (1) that is W-shaped is formed with the inner grooves (2), and the outer groove (3) is formed on the outer side (6) of the PVC segment (1) that is W-shaped; and a plurality of notch grooves (4) which are notched on the inner side (5) of the PVC segment (1), wherein the plurality of notch grooves (4) run through a first end (7) and a second end (8), opposite to each other, of the PVC segment and, extend in a length direction of the PVC segment;

wherein the PVC segment (1) is strip-shaped to form a main body structure of the annular shaped-charge housing, and the annular shaped-charge housing is formed by folding the PVC segment (1).

2. The PVC segment for forming the annular shaped-charge and blasting housing according to claim 1, wherein an opening of the outer groove (3) of the PVC segment (1) that is W-shaped has an angle of 60 degree.

3. The PVC segment for forming the annular shaped-charge and blasting housing according to claim 1, wherein the plurality of notch grooves (4) notched on the PVC segment (1) are spaced apart a predetermined distance from each other along the length direction of the PVC segment, a cross section of each of the plurality of notch grooves (4) which is perpendicular to the length direction of the PVC segment is V-shaped, and an opening of each of the plurality of notch grooves (4) has an angle that ranges from 40 degree to 60 degree.

4. The PVC segment for forming the annular shaped-charge and blasting housing according to claim 1, wherein a wall of the PVC segment (1) has a thickness that ranges 1 mm to 2 mm.

5. A method of using a PVC segment for forming the annular shaped-charge and blasting housing according to claim 1, comprising:

enabling a cross section of the PVC segment (1) to be W-shaped by stamping process;

notching the plurality of notch grooves (4) that are V-shaped on the inner side (5) of the PVC segment (1), and spacing apart the plurality of notch grooves (4) a determined distance from each other;

cutting the PVC segment (1) that is W-shaped, on which eight of the plurality of notch grooves (4) are notched, from an integral PVC segment;

folding the PVC segment after being cut, so as to form an octagonal annular housing by closing an opening of each of the notch grooves (4);

placing the octagonal annular housing to a bottom of a hole to be exploded after filling explosive into the octagonal annular housing, and enabling the outer groove (3) of the octagonal annular housing to face towards and be perpendicular to a wall of the hole.

* * * * *